United States Patent [19]

Tasseron

[11] Patent Number: 4,470,736

[45] Date of Patent: Sep. 11, 1984

[54] BUSHING HAVING A POLYGONAL FLANGE

[75] Inventor: Frans A. W. Tasseron, Heemstede, Netherlands

[73] Assignee: Koninklijke Emballage Industrie Van Leer B.V., Amstelveen, Netherlands

[21] Appl. No.: 342,499

[22] Filed: Jan. 25, 1982

Related U.S. Application Data

[63] Continuation-in-part of Ser. No. 115,363, Jan. 25, 1980, Pat. No. 4,319,477.

[30] Foreign Application Priority Data

Jan. 29, 1979 [NL] Netherlands ..... 7900689

[51] Int. Cl.[3] ..... B21D 22/00

[52] U.S. Cl. ..... 411/404; 411/187; 411/188; 411/427; 220/214

[58] Field of Search ..... 411/184–188, 411/404, 427; D8/397; 220/288, 214; 10/26, 86 A, 86 F

[56] References Cited

U.S. PATENT DOCUMENTS

| | | | |
|---|---|---|---|
| 28,212 | 1/1898 | Biedenfeld | D8/397 |
| 1,905,621 | 4/1933 | Cole | 10/86 A |
| 2,539,899 | 1/1951 | Delaney | 10/86 A |
| 2,551,102 | 5/1951 | Delaney | 10/86 A |
| 2,939,160 | 6/1960 | Mitchell | 10/26 |

*Primary Examiner*—Leon Gilden

*Attorney, Agent, or Firm*—Stevens, Davis, Miller & Mosher

[57] ABSTRACT

This invention relates to a bushing structure having a bushing (1) and a polygonal flange (2) said flange initially being formed with a circular circumference (5) having an outer diameter equal to the diameter of the inscribed circle (14) of the polygon to be made whereafter by means of cold deformation the material of the flange at the location of the angles of the polygon to be made is forced to flow outwards by means of a die pressed into the flat surface of the flange, the die having projections, the inner surfaces of which are steep with respect to the axis of the die and the bottom surface of which run obliquely and arching by upwards and outwards the radial width of said projections decreasing from the center to both sides.

4 Claims, 5 Drawing Figures

BUSHING HAVING A POLYGONAL FLANGE

RELATED APPLICATIONS

This application is a continuation in part of U.S. application Ser. No. 115,363 filed Jan. 25, 1980 now U.S. Pat. No. 4,319,477.

BACKGROUND OF THE INVENTION

The invention relates to a bushing structure having a polygonal flange. An example of such a bushing structure having a polygonal flange is disclosed in the U.S. Pat. Nos. 1,513,638 and 1,982,145, respectively. Usually such a bushing structure is provided with an internal thread for a screw plug and is used in the wall of a barrel in which a polygonal impression has been made for receiving the polygonal flange. The flange and the impression cooperate in order to keep the bushing in a fixed position when screwing a screw plug in its place in the bushing.

When producing such a bushing structure having a flange the flange portion is made by starting from a blank punched out of sheet metal, whereby in view of technical reasons when machining it is necessary that the dimensions of the blank are somewhat bigger than the final dimensions of the flange portion. Successive machining operations are utilized to form the bushing and the flange portion and to impart the correct dimensions whereby the polygonal flange is obtained by subsequently punching away the edge portions.

The above described way of manufacture leads to material losses. This invention envisages a bushing wherein material losses are avoided.

Punching operations entail the drawback that sharp edges may be formed which detrimentally affect the adhesion of a coating if the bushing is provided with a coating. Sharp edges may be avoided by frequent and accurate maintenance of the punch dies and/or additional operations. This invention furthermore envisages a bushing in which the development of sharp edges, particularly at the periphery of the polygonal flange portion is completely eliminated in a more simple manner.

According to the invention this object is attained by initially forming the flange of the bushing structure with an outer diameter which is circular and substantially equal to the diameter of the inscribed circle of the polygon to be made, then subsequently cold working the material of the flange at the location of the angles of the polygon to be made. This working is by means of a tool acting transversely on the plane of the flange in order to impart a forced outward flow to the material to an extent that the flow is the largest at the location of the angles and decreases in the direction of the points lying between said angles. Hence the invention is based on the conception of starting from a circular flange of too small a size followed by imparting thereto a polygonal shape by local impression.

Otherwise than upon punching this operation is not conducive to sharp edges. Moreover the material is strengthened by the cold working operation.

The bushing portion running from the flange is made by removing a circular center portion from the blank punched out of sheet metal and converting the inner edges into a cylindrical sleeve. At a later step the cylindrical sleeve is provided with an internal screw thread. These are generally known operations; it is novel however that out of the sheet metal there is punched a blank which is smaller than the blank employed by known methods but the final product, after subsequent processing, is just as large as that made by present methods.

DESCRIPTION OF THE PREFERRED EMBODIMENT

The tool for applying the invention is disclosed in parent application Ser. No. 115,363, now U.S. Pat. No. 4,319,477 and need not be discussed here in detail. Generally speaking the forming tool preferably comprises a polygonal recess cavity for receiving the flange and a die having projections facing towards said cavity at circumferentially spaced locations above the angles of said recess and within the inscribed circle. The length of the projections is slightly less than the depth of the cavity recess. The inner surface of said projecions are steep, i.e. parallel to or approximately parallel to the axis of the recess and die, the bottom surface of said projections running obliquely and archingly upwards and outwards, respectively, with the radial width of said projections decreasing from the center to both sides thereof. In essence a tool is thus formed into the material of the flange at the location of an angle of the polygon to be made, said tool having such a shape that the material of the flange is made to flow from the circular shape into the angular shape.

The invention will now be described in further detail with reference to the accompanying drawings which show the invention by way of example and not of limitation as follows.

Figure 1:
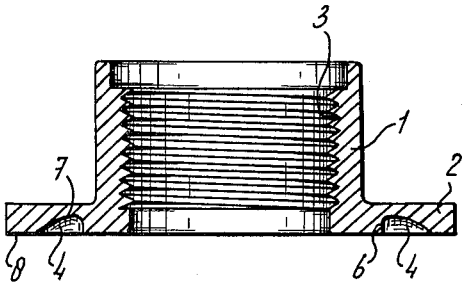
FIG. 1 is a cross section of the bushing structure having the flange of the present invention.

With reference to FIG. 1 there is shown a bushing 1 having a flange 2, the bushing having an internal screw thread 3. Within the lower side of the flange there are indicated recesses 4. The bottom view of the flange represented in this sectional view would be as in FIGS. 2, that is of hexagonal shape although it may also have a different number of angles, preferably eight.

Figure 2:
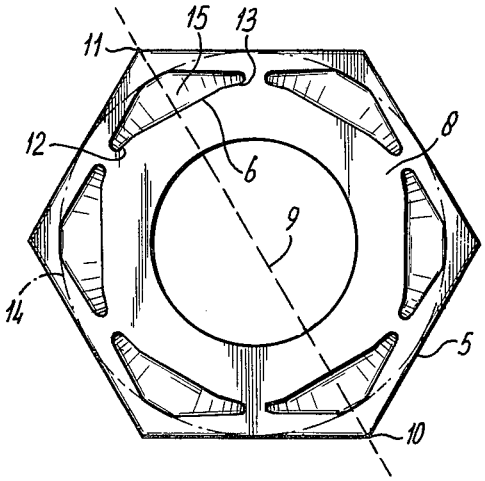
FIG. 2 is a plan view showing the location of the recesses within the flange and FIGS. 3, 4, and 5 are plan views similar to FIG. 2 showing other shapes of recesses.

From FIG. 2 it is apparent that the blank originally had a circular shape determined by the periphery 5 of the inscribed circle of the flange 2.

Upon stamping the circular blank having the periphery 5 and the manufacture of the bushing portion 1 as known in the prior art, a bushing with its flange still in the original circular shape is positioned within a hexagon shaped cavity, the height of which corresponds approximately to the thickness of the flange 2.

The circular flange 2 is forced into the hexagonal shape by means of a die having projections. The dimensions of these projections are such that upon forcing said projections into the material of the flange this material is displaced outwardly in such a manner that the arcuate periphery is converted into an angle having substantially straight sides. Consequently it is necessary to displace a larger amount of material in the center accompanied by a gradual decrease of the material displacement towards the sides. For effectuating the outward displacement the projection of the die has an inner face running parallel or substantially parallel, respectively, to the axis of the die, i.e. running steeply in such a manner that the angle with respect to the axis is very acute whereas the bottom surface runs obliquely upwards in outward direction, which bottom surface may have a flat or arcuate plane. Details of the die are found in parent application Ser. No. 115,363.

In FIG. 1 the shape of the impression has been indicated at 4 in cross section.

From FIG. 2 the shape of the impression in plan view of the first embodiment will be apparent. From FIG. 2 it will also be evident how the radial width of the projections and consequently of the impressions decreases in the middle of the sides of the polygon. Each one of the projections serves to displace such an amount of material that the free space between the periphery 5 of the flange and the side wall of the hexagonal recess within the die cavity will be completely filled, which condition will have to be reached when the cavity and the die come to rest on each other.

As seen in FIG. 1 the recess 4 has a steep side wall 6 extending substantially parallel to the axis of the bushing portion 1 and outside the outer diameter of said bushing portion 1. The bottom portion 7 gradually curves and slopes back to the plane 8 of the flange 2.

As seen from the plan view of FIG. 2 the recess has a shape resembling a triangle and this shape is symmetrical with respect to the line 9 through opposite angles 10 and 11. The bottom 7 of each recess slopes gradually towards the plane 8 in the same way as seen in the cross section of FIG. 1 and is almost flush with said plane at the corners 12 and 13.

The flange material which originally has the shape of circle 14 has been reshaped into the polygonal shape 5 by means of the dies making the recesses 4 as previously described.

Figure 3:
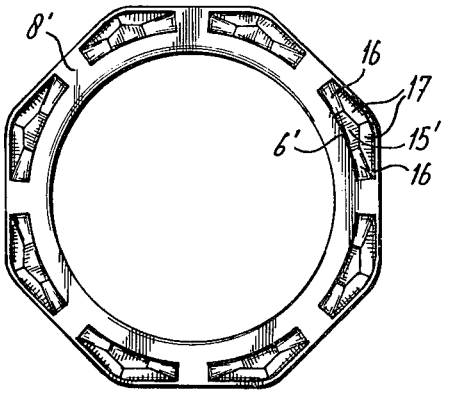
Figure 4:
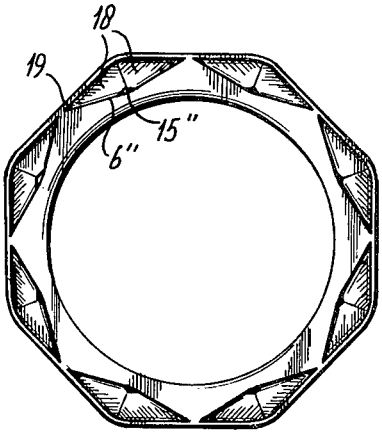
Figure 5:
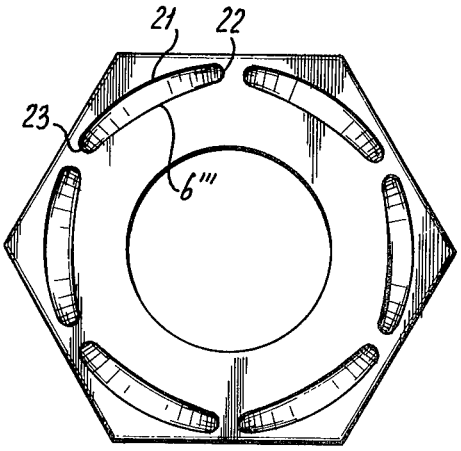

FIGS. 3, 4 and 5 show other shapes of the recesses in plan view.

All recesses have a portion with their greatest depth in the center of the recess which in FIG. 2 is at 15.

In the embodiment of FIG. 3 the portion with the greatest depth 15′ is a flat portion adjacent to the steep side wall 6′ and further surrounded by inclined flat surfaces 16 and 17 sloping upwardly towards the plane 8′.

In the embodiment of FIG. 4, the portion 15″ is of the greatest depth and has the form of a very small triangle. The steep inner side wall 6″ of the recess extends slightly towards the outer edge and is, when viewed in plan, of a flattened "V" shape with the point of the "V" being opposite the greatest radial protrusions of the angle of the polygonal periphery. The recesses have a shape, when viewed in plan, of an asymmetrical diamond with the inner steep wall 6″ not having as sharp a central angle as the opposite outer wall of the recess. Two slanting surfaces 18 extend from the point of greatest depth 15″ upwardly and curvedly to the outer edge of the recess. They define with steep edge 6″ a sharp angle 19 at the points where they join. Points 19 lie approximately on the inscribed circle 14 which defined the cirumference prior to deformation to form the polygonal shape.

FIG. 5 shows an embodiment in which the steep inner wall 6‴ of the recess is of arcuate shape and the outer slanting wall 21 is also of arcuate shape but with a small radius so that the outer wall 21 and the inner wall 6‴ meet at point 22 and 23 with the bottom sloping according to a smooth curve.

It will be clear that the impression does not necessarily have to be made on the lower side of the flange but that such impression may also be made on the upper side or on both sides, respectively.

What is claimed is:

1. A steel bushing structure comprising a bush portion having a screw thread and a flange portion at one end of the bush portion, said flange portion having a polygonal circumference and an end surface on its outer end face, a plurlity of circumferentially spaced apart recesses pressed into said end surface of the flange portion, one recess being located at each corner of the polygonal flange between the outer edge of said flange and the outer diameter of the bush portion, each recess having a steep wall at the side which is close to the bush portion, the other walls or bottom of each recess extending gradually towards said end surface, said recesses having their largest cross section in a radial plane through the corners of the flange, said cross section gradually decreasing in opposite directions of said plane, each recess having a volume substantially corresponding to the volume of flange material at each corner between the outer edge of the flange and the inscribed circle, the deformation flow lines of the flange structure at and outside each recess being a structure of cold deformation.

2. A bushing structure as claimed in claim 1 wherein the bottom of each recess is smoothly curved towards the plane of the flange.

3. A bushing structure as claimed in claim 1 wherein the bottom of each recess is formed by a flat central surface and a plurality of sloping surfaces.

4. A bushing structure as claimed in claim 1 wherein the bottom of each recess is formed by a small triangular plane bordering the lower end of the steep wall and by two sloping triangular surfaces.

* * * * *